US008479948B2

(12) United States Patent
Weiss et al.

(10) Patent No.: US 8,479,948 B2
(45) Date of Patent: Jul. 9, 2013

(54) CLOSURE LID WITH IDENTIFYING MEANS

(75) Inventors: David I. Weiss, Plantation, FL (US); Mark Strachan, Jupiter, FL (US)

(73) Assignee: uVu Lid Company, LLC, Boca Raton, FL (US)

( * ) Notice: Subject to any disclaimer, the term of this patent is extended or adjusted under 35 U.S.C. 154(b) by 0 days.

(21) Appl. No.: 13/456,509

(22) Filed: Apr. 26, 2012

(65) Prior Publication Data

US 2012/0272622 A1 Nov. 1, 2012

Related U.S. Application Data

(60) Provisional application No. 61/480,624, filed on Apr. 29, 2011.

(51) Int. Cl.
*B65D 41/16* (2006.01)
*B65D 85/00* (2006.01)

(52) U.S. Cl.
USPC ..... 220/794; 206/459.1

(58) Field of Classification Search
USPC ..... 220/794, 792, 790, 789, 785, 783, 220/780, 802, 801, 797, 796, 713, 711, 380, 220/720; 215/344, 343, 200, 230; 229/404; D9/452, 449; 40/311
IPC ..... B65D 41/16,53/00, 85/00
See application file for complete search history.

(56) References Cited

U.S. PATENT DOCUMENTS

| | | | | | |
|---|---|---|---|---|---|
| 3,065,875 | A | * | 11/1962 | Negoro | 220/784 |
| 3,326,262 | A | | 6/1967 | Bennett et al. | |
| 3,392,468 | A | | 7/1968 | Wolf | |
| 3,589,552 | A | * | 6/1971 | Fitzgerald et al. | 220/781 |
| 3,722,731 | A | * | 3/1973 | McCormick et al. | 220/781 |
| D243,231 | S | * | 2/1977 | Smith | D9/439 |
| 4,241,864 | A | * | 12/1980 | Kessler | 229/5.5 |
| 4,390,113 | A | * | 6/1983 | Bird | 220/785 |
| 4,418,833 | A | | 12/1983 | Landis | |
| 4,585,140 | A | | 4/1986 | Lambert et al. | |
| 4,723,684 | A | | 2/1988 | Lambert et al. | |
| 5,427,266 | A | | 6/1995 | Yun | |
| 5,996,837 | A | | 12/1999 | Freek et al. | |
| 6,170,710 | B1 | | 1/2001 | Suffa | |
| 6,207,100 | B1 | | 3/2001 | Weiss et al. | |
| 6,230,924 | B1 | | 5/2001 | Weiss et al. | |
| D468,206 | S | * | 1/2003 | Weiss et al. | D9/447 |
| D649,878 | S | * | 12/2011 | Weiss | D9/447 |
| 2002/0005368 | A1 | | 1/2002 | Ferretti | |
| 2008/0041862 | A1 | | 2/2008 | Bal | |

* cited by examiner

*Primary Examiner* — Mickey Yu
*Assistant Examiner* — Robert J Hicks
(74) *Attorney, Agent, or Firm* — Fox Rothschild, LLP

(57) ABSTRACT

A lid for securing to the rim of a container, the lid including inverted dimples positioned along a top wall of the lid for engaging the rim of the container. The top wall includes one or more inverted dimples which reverse direction and pop up to project outwards and upwards from beyond the top wall of the lid when the lid is applied to the rim of a container. When all the dimples are raised, the lid is seated firmly on the container. The raised dimples provide both visual and tactile confirmation of a secure seal of the lid to the rim of a container.

20 Claims, 7 Drawing Sheets

CLOSURE LID WITH IDENTIFYING MEANS

CROSS-REFERENCE TO RELATED APPLICATIONS

This application claims the benefit of U.S. provisional application No. 61/480,624 filed Apr. 29, 2011, the disclosure of which is incorporated in its entirety herein by reference.

BACKGROUND OF THE INVENTION

1. Field of the Invention

The present disclosure relates generally to a lid for a container. More particularly, the present invention is directed to a closure indicator for a lid of a container, wherein the closure indicator comprises a plurality of inverted dimples positioned along the top wall of the annular periphery of the lid. The inverted dimples reverse direction and project outwards when the top wall of the annular periphery of the lid mates with the rim of a container. The outwardly projecting dimples thus function as a means of identifying whether the lid is sealed to the rim of the container and properly secured thereon.

2. Description of the Related Art

Lids known in the art include an annular rim that fastens onto the rim of a beverage container. However, the prior art lids are often deficient in that if applied in haste or if the container is bent it is easy to include a slight gap or tolerance defined between the periphery of the annular rim and the periphery of the container. Once a user picks up a beverage container and attempts to drink from the container, the lid may become separated from the container and spillage may occur. Also, it is often difficult to quickly and accurately assess whether the lid is properly secured to the beverage container. In addition, the gap or tolerance between the periphery and rim will likely cause the lid to become completely dislodged from the container in the event a user accidentally spills the container, resulting in spillage of the contents therein.

Lids known in the art do not achieve a satisfactory sealing or fastening arrangement with the rim of a beverage container and are therefore prone to contributing to accidental spillage and leaking.

It is desirable to have a means of confirming proper lid closure via tactile as well as visual means in order to avoid accidental leaking or spilling of the contents within a beverage or food storage container.

SUMMARY OF THE INVENTION

In accordance with the present invention, a lid for a container comprises a container closure including a plurality of inverted dimples for securing to the rim of a container. Dimples are defined herein as depressions or dents. In a preferred embodiment, the container closure portion of the lid comprises a disk shaped member including a circumferential rim extending about a periphery of the container closure. The circumferential rim of the periphery of the disk shaped member mates with the rim of the beverage container for sealing engagement therewith. The circumferential rim includes an annular outer side wall, an annular inner side wall and an annular top wall, interconnecting the outer side wall and the inner side wall. The outer side wall is disposed opposite to the inner wall and is contiguous to the top wall. In one embodiment, a plurality of inverted dimples is positioned on a surface of the annular top wall. In a preferred embodiment, four inverted dimples are positioned in each quadrant of the annular top wall of the lid. In another embodiment, each dimple is mounted on top of a support base. In a preferred embodiment, the support base includes a plurality of raised surfaces which project to form a support for the dimple at the apex.

The bottom portion of the inverted dimples make contact with the rim of the container when the lid is placed on top of a rim of a container. A consequent downward force applied to the annular top wall along either side of the indented dimples will cause the inverted dimples to reverse direction and project outwards from beyond a surface of the annular top wall.

In one embodiment, markings or etchings may be placed on either side of each dimple to denote pressure points. A pressure point is defined herein to include a portion of the annular top wall that is proximate to the dimple and is susceptible to the application of finger pressure. A secure fit of lid to container can be achieved by applying a downward force on the pressure points causing the inverted dimples to pop up and project outwards. When the lid is firmly seated on the container all the dimples will be in a raised configuration projecting outwards, providing visual and tactile confirmation of a secure seal.

In this manner, when the lid is affixed to the rim, visual inspection of the lid with respect to the container is readily apparent and the structural integrity of the fastened lid in conjunction with the container can be assessed. Tracing the top annular wall with one or more fingers allows a user to touch the upper crown of the outwardly projecting dimples. Thus, the outwardly projecting dimples will serve to provide tactile as well as visual confirmation that the lid is securely attached.

It is an objection of the invention to provide a plurality of inverted dimples positioned along a top wall of a lid for a container.

It is another object of the invention to provide a lid with an inverted dimple in each quadrant of the lid.

It is yet another object of the invention to provide a lid with four inverted dimples, positioned evenly along a container closure of a lid.

It is an object of the invention to provide a lid with a plurality of support bases positioned along the top annular wall of the lid, wherein a dimple is mounted at the apex of each of the support bases.

It is another object of the invention to provide a lid with four inverted dimples positioned along a top wall of a lid for a container, wherein the inverted dimples will reverse direction and project outwards beyond the top wall of the lid when the lid is firmly secured to the rim of a container. Tracing the top annular wall with one or more fingers allows a user to touch the upper crown of the outwardly projecting dimples, while the outwardly projecting dimples will also provide visual confirmation that the lid is securely attached.

Accordingly, it is a principal object of the invention, to provide a lid which will afford a visual and tactile means to ascertain that a lid is firmly seated or secured to the rim of a container to minimize the risks associated with accidental leaks and spills.

It is an object of the invention to provide a lid that is made of flexible and deformable material, such that inverted dimples on a top wall of the lid readily reverse direction and project outwards when the lid is seated to a rim of a container.

The material from which the lid is made is flexible and deformable and because of the configuration of the dimple, the dimples readily reverses direction to project outward when the tip of the inverted dimples mate with the rim of a container. Conversely, if a dimple may revert to its original inverted position, by removing the lid from the container.

It is contemplated that based on the type of design resin, plastic polymer, tooling, production method and/or forming method used, the dimple may revert to its inverted state once the lid is lifted from the rim It is yet another object of the invention to provide a lid that is manufactured using a female cavity mold in order for the plastic material to be thin and flexible enough for the dimples to pop up when the lid is placed on a cup and then pop down again to their inverted position after the lid is removed.

The summary of the present invention will become readily apparent upon further review of the following specifications and drawings.

DETAILED DESCRIPTION OF THE PREFERRED EMBODIMENTS

Figure 1:
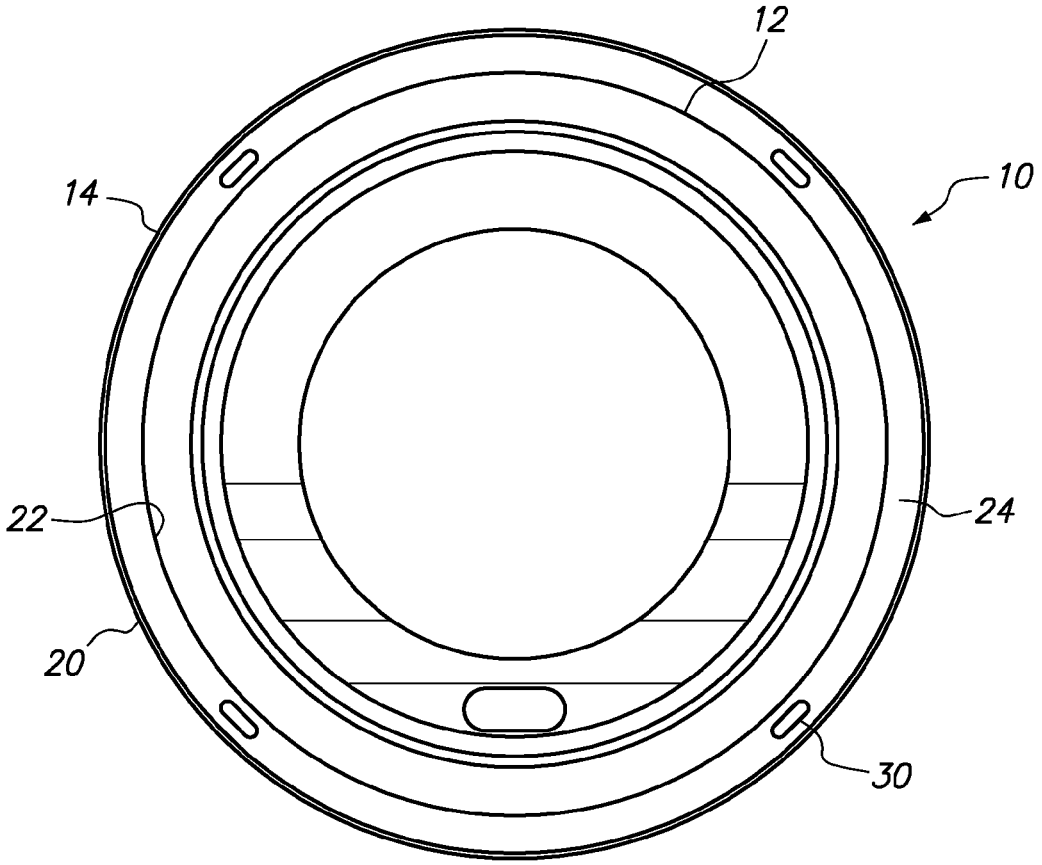
FIG. 1 is top view of a lid illustrating the dimples in an inverted position.

It is contemplated that the teaching of the description set forth below is applicable to all types of packaging, including but not limited to, disposable beverage cup containers made from styrofoam, compostable plastic or polymer material, thermoplastic, paper for coffee, tea, soda or other suitable material, as is readily appreciated by one skilled in the art. The present disclosure is therefore not intended to be limited to any particular container apparatus or configuration described in the exemplary embodiments of the present disclosure. It should be appreciated that the present invention may also be applicable to other types of containers, including but not limited to non-disposable beverage containers, such as, for example, a vacuum sealed travel coffee cup, and food storage containers.

Referring now to FIGS. 1-7A, the present invention is a lid, designated as 10. The lid 10 may be composed of recyclable material such as PET, RPET, polypropylene, polystyrene, polyethylene, high impact polystyrene or other suitable material. The preferred material of the lid is a flexible and deformable plastic material. The lid 10 includes a container closure 12. The container closure 12 is preferably a disk shaped member made from a moldable or stamped material and includes a circumferential rim 14 extending about a periphery of the container closure 12. The circumferential rim 14 is adapted for mating with a rim 40 of a container 42 for sealing engagement therewith.

The circumferential rim 14 includes an annular outer side wall 20, an annular inner side wall 22 and an annular top wall 24, interconnecting the outer side wall and the inner side wall for mating with the rim 40 of a container 42. The outer side wall 20 is disposed opposite to the inner wall 22 and is contiguous to the top wall 24. In one embodiment, a plurality of inverted dimples 30 are positioned along the annular top wall 24 such that prior to engagement of the lid 10 with the rim 40 of the container 42, crown 32 of the inverted dimples 30 are directed towards the rim 40 of the container 42.

In a preferred embodiment four equally spaced inverted dimples 30 are positioned over each quadrant of the lid 10. The crown 32 of the inverted dimple 30 reverses direction and projects outwards when the lid 10 is seated thinly to the rim 40, such that the crown 32 are directed away from the rim 40 of the container 42. The crown 32 of the raised dimples 31 project outwards beyond the surface of the top wall 24 such that the crown 32 of the raised dimples 31 may be observed visually from a side or top perspective view. The sight of the raised dimples 31 will confirm that the lid 10 is properly seated or fitted to the rim 40 of a container 42. The crown 32 of the raised dimples 31 may also be perceived by tactile means by tracing a finger along the surface of the top wall 24. The raised dimples 31 are generally semi-elliptical in shape, but may also be semi-spherical, triangular, rectangular, square or any other suitable geometric shape or size.

The annular outer side wall 20 extends around the annular inner wall 22. Annular outer side wall 20 is generally parallel to and opposite the annular inner side wall 22. Annular walls 20 and 22 are interconnected by an annular top wall 24 which is generally perpendicular to walls 20 and 22. The dimples 30, 31 as shown are located along the annular top wall 24.

The raised annular inner side wall 22 and the raised annular outer side wall 20 along with annular top wall 24 extend around the periphery of the lid 10 and form a channel 28 therebetween. Channel 28 preferably is sized to fit the rim 40 of a container 42.

Inverted dimples 30 remain in position until the lid 10 is placed over the rim 40 of a container 42. When the lid 10 is placed over the rim 40 of a container 42, the crown 32 of the inverted dimples 30 are in communication with the rim 40 of the container 42. A consequent downward pressure on the top annular wall 24 forces the crown 32 of the inverted dimples 30 to reverse direction and project upwards in a raised position so that the dimples 31 may be perceived by visual or tactile means.

Crown 32 of the inverted dimples 30 extend below the surface of the annular top wall 24 and are at least partially enclosed within the channel 28. When lid 10, is placed over the rim 40 of the container 42 for seating the lid 10 to the rim 40, the crown 32 of the dimples 30 contact the rim 40 of the container 42. Applying finger pressure to the top of the lid 10 will cause the crown 32 of the inverted dimples 30 to reverse direction and pop up and project outwards beyond the top surface of the top wall 24 of the lid 10 thereby providing tactile and visual confirmation that the lid 10 is firmly seated to the rim 40 of a container 42.

In another embodiment, a recessed dimple 33 is mounted to a support base 50 and is located within a cavity 56 of the support base 50. The recessed dimple 33 is raised beyond an apex 54 of the support base 50 when the lid 10 is firmly seated to the rim 40 of the container 42. In a preferred embodiment, the support base 50 includes a plurality of raised panels 52 which project to form a support for the recessed dimple 33 at the apex 54.

In yet a further embodiment, an inverted dimple 30 is mounted to a support base 50 and is located within the cavity 56 of the support base 50. The inverted dimple 30 reverses direction and projects upwards to assume a raised position 31 beyond the apex 54 of the support base 50 when the lid 10 is seated to the rim 40 of the container 42.

Thus, in this manner, when the lid 10 is affixed to the rim 40, visual inspection of the lid 10 with respect to the container 42 is readily apparent and the structural integrity of the fastened lid 10 in conjunction with the container 42 can be assessed. It is noted that any number, size and configuration of the dimples 30, 31 may be included so long as the visual inspection of the lid 10 with respect to the rim 40 of the container 42 is readily apparent and the structural integrity of the lid 10 is maintained. In a preferred embodiment four dimples 30, 31, 33 are equally spaced over each quadrant of the lid 10. The precise spacing and number of dimples 30, 31, 33 may vary. Various configurations of the lid 10 and dimples 30, 31, 33 are possible and within the scope of the present disclosure. It will be appreciated by those reasonably skilled in the art that the dimples 30, 31, 33 and lid 10 may include various diameters and heights based on the type of lid 10 and container.

Now particularly referring to FIG. 1, there is shown a top view of a lid 10 illustrating the dimples 30 in an inverted position. The main components of the lid 10, include the closure 12 having a rim 14 extending about the periphery, the annular outer side wall 20 extending around annular inner side wall 22. Annular walls 20 and 22 are interconnected by annular top wall 24. The dimples 30 are positioned along the top annular wall 24. As shown in FIG. 1, a dimple 30 is in each quadrant of the lid 10. Annular inner side wall 22 and annular outer side wall 20 are interconnected by annular top wall 24.

Figure 2:
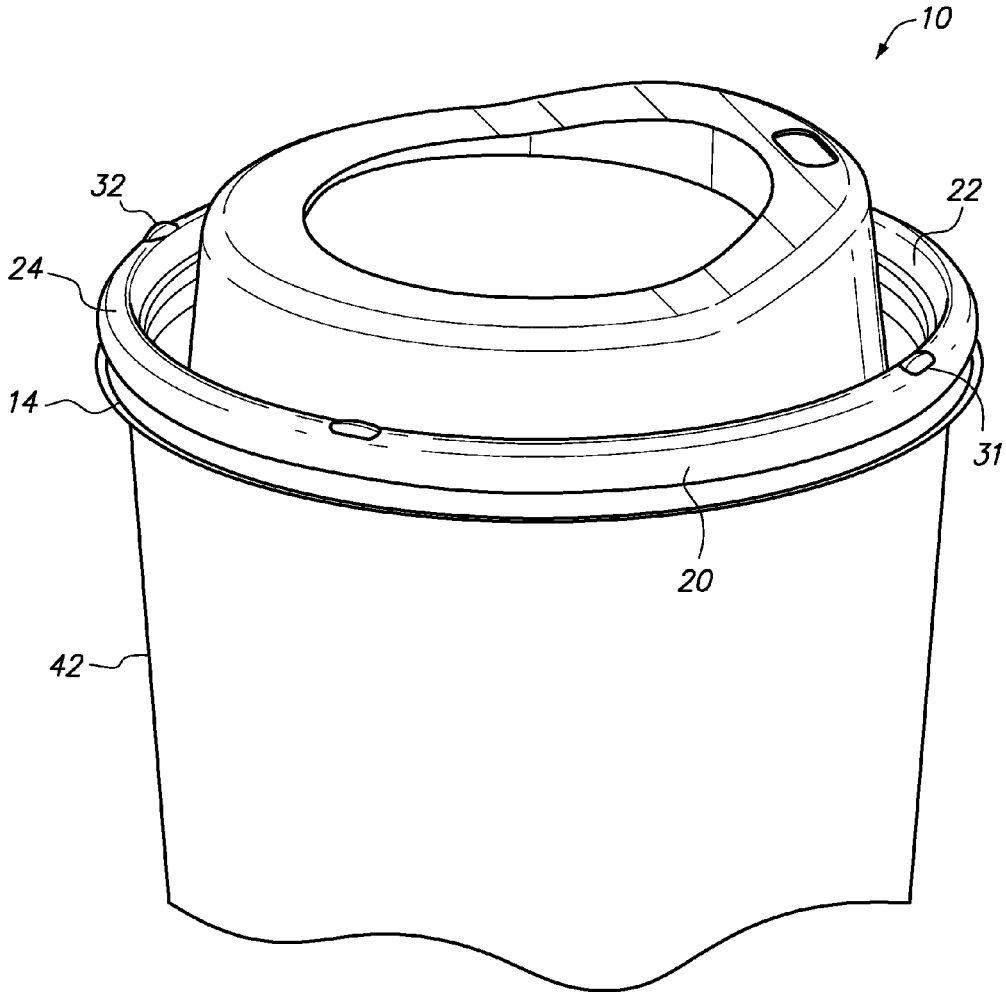
FIG. 2 is a side perspective view of the lid firmly seated on a container illustrating the dimples activated and projecting upwards in a raised pop up position.

Referring now to FIG. 2 there is shown a side perspective view of the lid 10 firmly seated to the rim 40 (not shown) of a container 42 with the dimples 31 activated and projecting upwards and the crowns 32 in a raised pop up position. The raised dimples 31 may be perceived visually by viewing the lid from the side view or by tracing a finger along the surface of the annular top wall 24. The raised dimples 31 may be perceived visually from a top view or by tracing a finger along the surface of the annular top wall 24.

Figure 3:
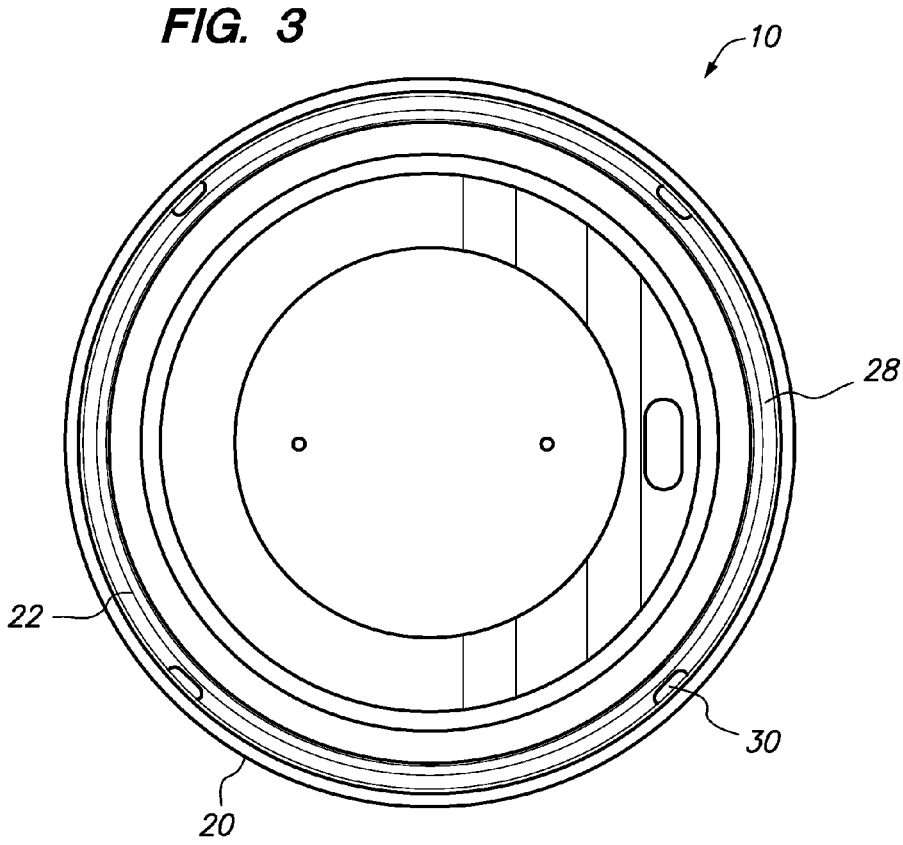
FIG. 3 is a bottom view of the lid with the dimples in a de-activated and inverted position.

FIG. 3 is a bottom view of the lid 10 with the inverted dimples 30 in a de-activated position. The annular inner side 22, outer side 20 and top 24 walls extend around the periphery of the lid 10 and form a channel 28 therebetween. As shown, the crown 32 of the inverted dimples 30, project downwards within the channel 28, away from the surface of the top annular wall 24.

Figure 4:
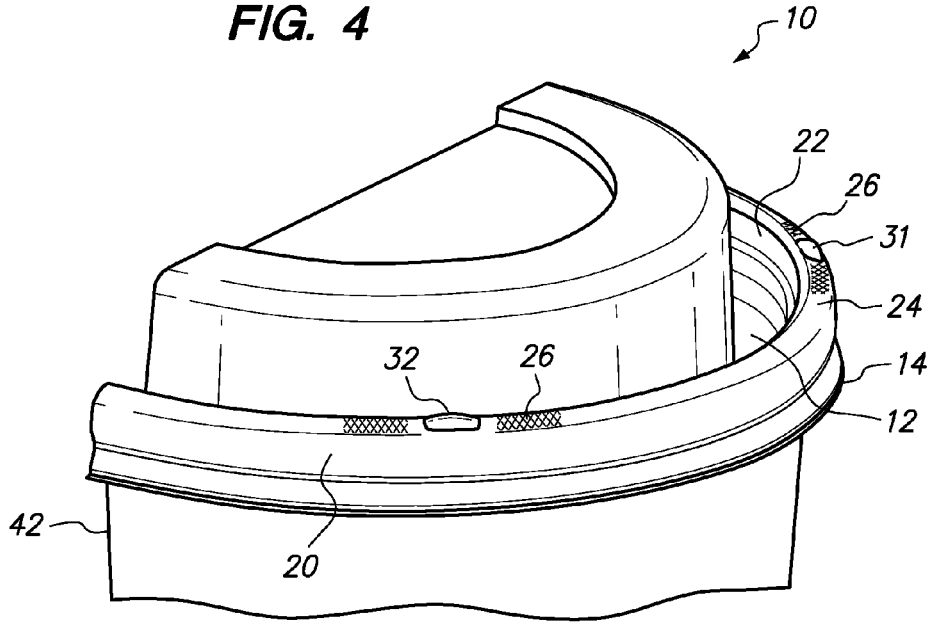
FIG. 4 is a partial view of an embodiment of the lid illustrating pressure point markings on either side of the activated dimples in a raised pop up position.

FIG. 4 is a partial view of an alternative embodiment of the lid 10 seated to a container 42. The lid 10 in this alternative embodiment includes pressure points 26 positioned on either side of the dimples 30, 31. FIG. 4 illustrates the general location the pressure points 26 positioned on either side of the activated dimples 31 in a raised pop up state. The pressure points 26 are shown as etchings, however, the pressure points 26 may be designated by other markings or any tangible means.

Figure 5:
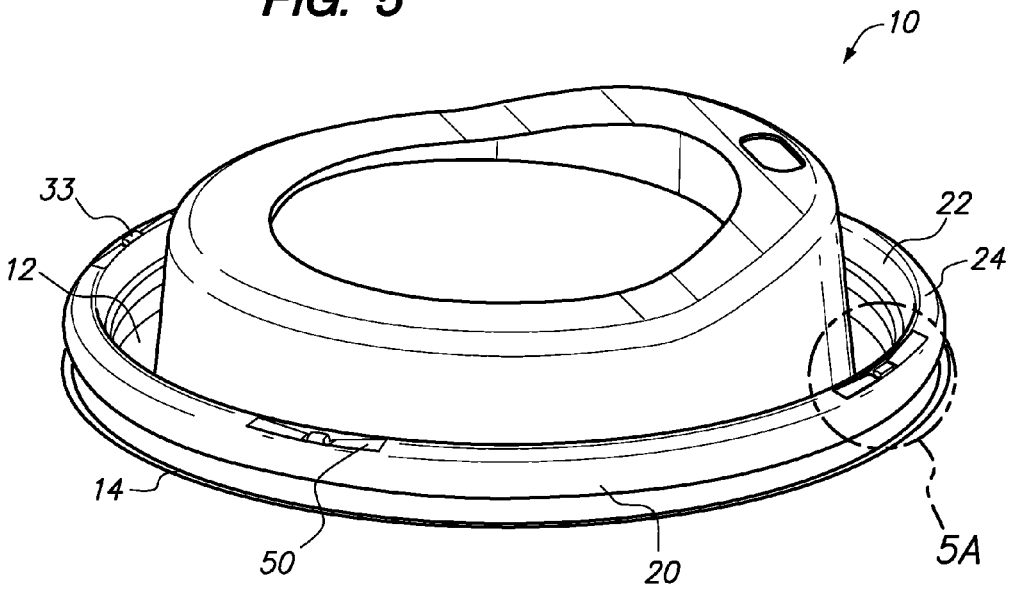
FIG. 5 is a rear perspective view of an alternative embodiment of the lid with the recessed dimples mounted on a support base.

Now referring to FIG. 5, yet another alternative embodiment of the lid 10 of the present invention is shown. In this embodiment, recessed dimples 33 are individually mounted on top of a plurality of support bases 50.

Figure 5A:
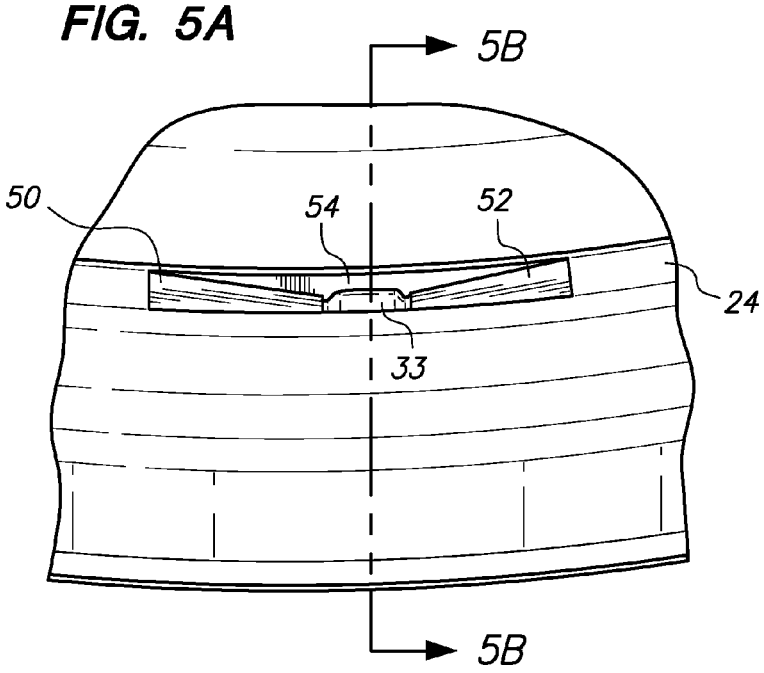
FIG. 5A is a partial view of section 5A in FIG. 5 of a dimple in a recessed position and mounted on a support base.

Now referring to FIG. 5A, there is shown a close up view of a recessed dimple 33 mounted on top of a support base 50. The support base 50 is shown to include a plurality of panels 52. The panels 52 project upwards from the annular top wall 24 to form a pyramid structure that supports the dimple 30, 31. The recessed dimple 33 is mounted on the support base 50 at an apex 54.

Figure 5B:
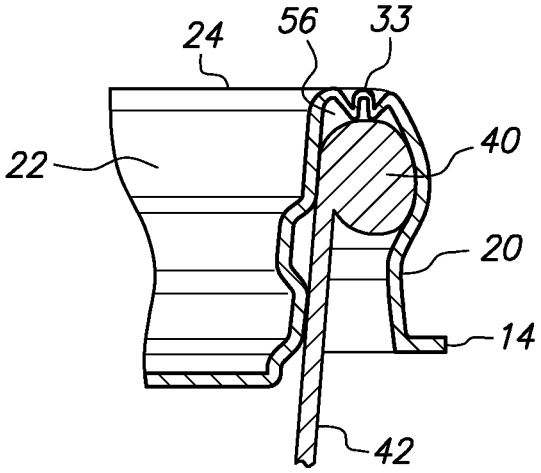
FIG. 5B is cross sectional view taken along line 5B-5B of FIG. 5A and further illustrates the lid placed over the rim of a container but not firmly seated thereto.

FIG. 5B is cross sectional view of the lid 10 of the present invention taken along line 5B-5B of FIG. 5A illustrating a recessed dimple 33 mounted on a support base 50. As illustrated, the panels 52 of the support base 50 surround the cavity 56 within the support base 50 for receiving the recessed dimple 33. The lid 10 is shown in contact with the rim 40 of the container 42, but not firmly seated thereto as indicated by the lowered position of the recessed dimple 33.

Figure 5C:
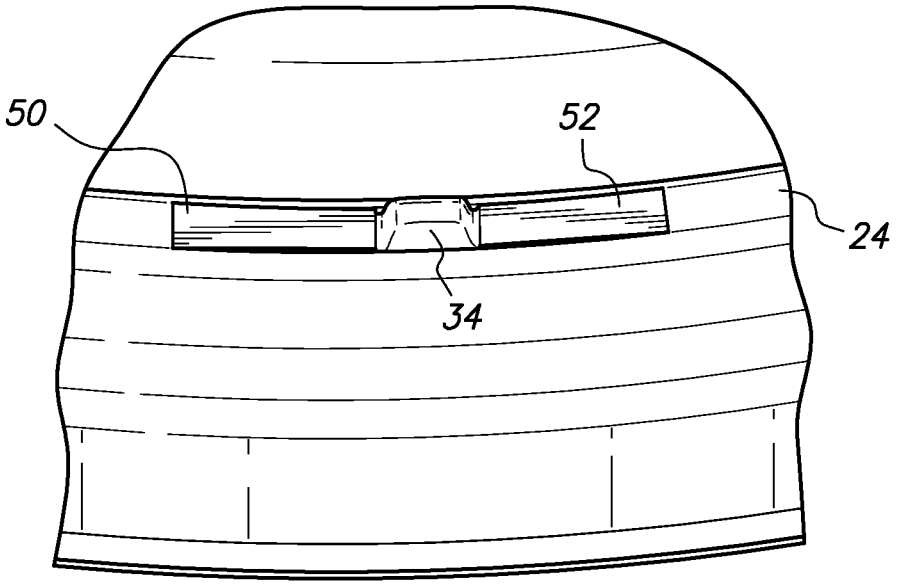
FIG. 5C is a partial view of section 5A in FIG. 5 of a recessed dimple in a raised position and mounted on a support base.

FIG. 5C is a partial view of section 5A in FIG. 5 of the recessed dimple of FIG. 5A in a raised position 34 and mounted to a support base 50. In this configuration, the lid 10 is firmly seated to the rim of the container (not shown) as indicated by the raised recessed dimple 34.

Figure 6:
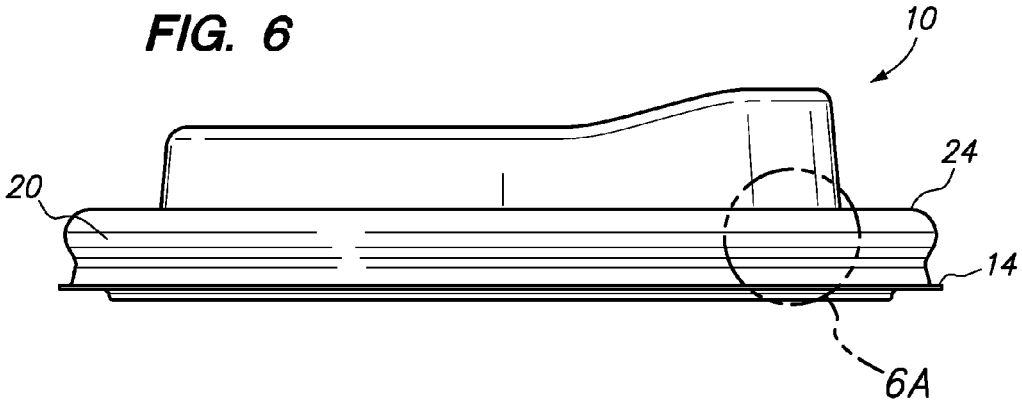
FIG. 6 is a side view of the lid with the de-activated dimples in an inverted position.

FIG. 6 is a side view of the lid 10 with the de-activated dimples 30 in an inverted position. As shown, the dimples 30 are not visually perceptible when the lid 10 is viewed from a side perspective.

Figure 6A:
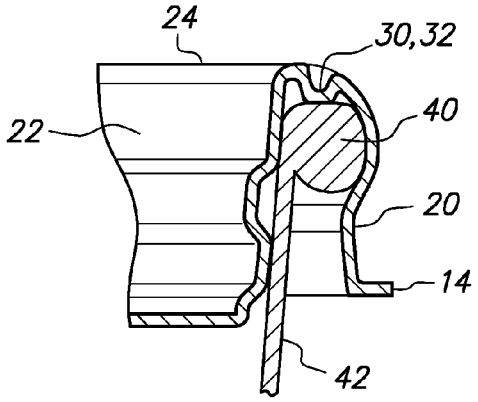
FIG. 6A is a partial view of section 6A of FIG. 6 illustrating an inverted dimple of the lid making contact with the rim of a container.

FIG. 6A is a close-up sectional view of 6A of FIG. 6 illustrating an inverted dimple 30 of the lid 10 making contact with the rim 40 of the container 42. The crown 32 of the dimple 30 is in communication with the rim 40. As illustrated by the state of the inverted dimple 30, the lid 10 is not firmly seated on the rim 40 of the container.

Figure 7:
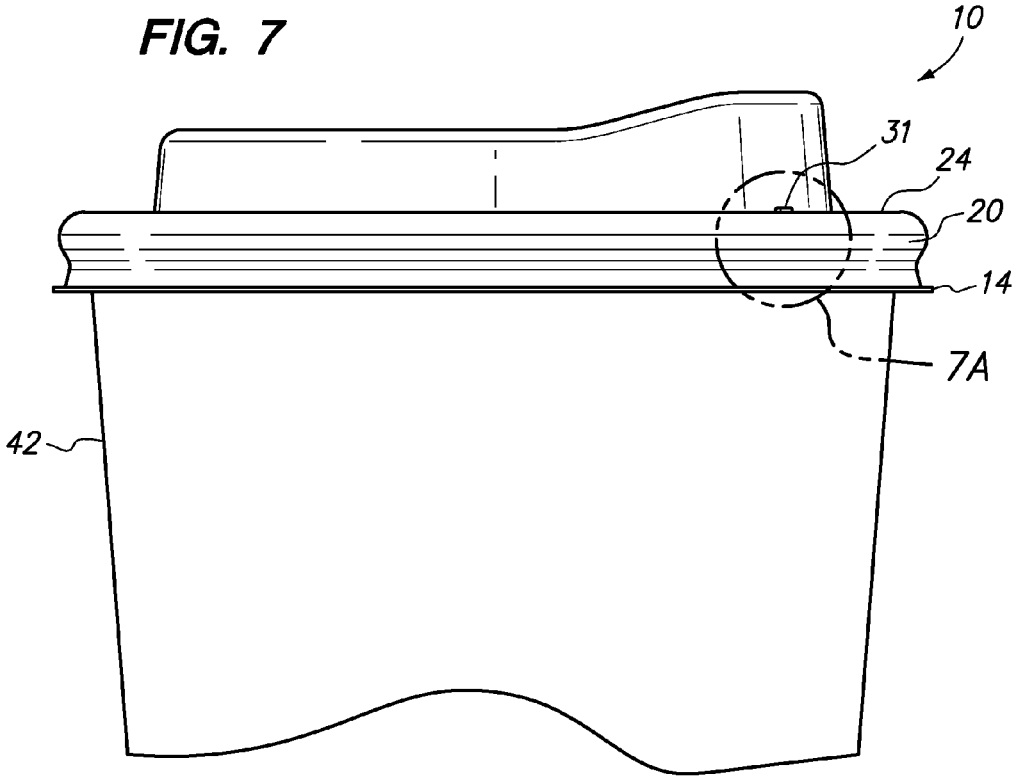
FIG. 7 is a side view of the lid with the activated dimples in a pop up position.

Referring to FIG. 7, there is shown a side perspective view of the lid 10 with the activated dimples 31 in a raised pop up position. As is shown, the raised dimples 31 are visually perceptible. The raised dimples 31 may also be perceived by tracing the surface of the top annular wall 24.

Figure 7A:
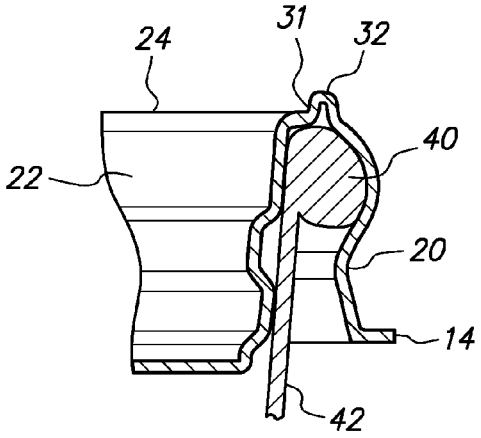
FIG. 7A is a partial view of section 7A of FIG. 7 illustrating an activated dimple in a raised pop up position when the lid is firmly seated over the rim of a container.

Now referring to FIG. 7A there is shown a close up sectional view of 7A of FIG. 7 illustrating an activated dimple 31 in a raised pop up position when the lid 10 is firmly seated over the rim 40 of the container 42. As shown, the crown 32 of the dimple 31 is no longer in communication with the rim 40 and projects outward beyond the surface of the annular top wall 24 when the lid 10 is firmly seated on the rim 40 of the container 42.

Thus, while there have shown and described and pointed out fundamental novel features of the disclosure as applied to various specific embodiments thereof, it will be understood that various omissions and substitutions and changes in the form and details of the apparatus illustrated, and in their operation, may be made by those skilled in the art without departing from the spirit of the disclosure. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A lid for sealing a container, the lid comprising:

a closure having a circumferential rim extending about a periphery, wherein the circumferential rim is adapted for mating with a rim of the container;

the circumferential rim further comprising a raised annular inner side wall, a raised annular outer side wall, wherein the outer side wall extends around the inner side wall and is generally parallel to and opposite the inner side wall, the outer side wall and inner side wall being interconnected by an annular top wall, the annular top wall being generally perpendicular to the outer side and inner side walls;

wherein the combination of the raised annular inner side wall, the raised outer side wall and the annular top wall form a channel therebetween;

the annular top wall further including a plurality of inverted dimples positioned along a top surface of the annular top wall; and the inverted dimples of the annular top wall projecting downward within the channel, the downwardly projecting dimples being at least partially enclosed within the channel, for engaging a container rim when the lid is positioned over the container.

2. The lid according to claim 1, wherein a bottom portion of the plurality of inverted dimples is for communication with the rim of the container.

3. The lid according to claim 1, wherein at least one of the plurality of inverted dimples reverses direction and projects upwards beyond the annular top wall to assume a raised position, pursuant to the application of a downward force on either side of the at least one inverted dimple when the lid is seated to the rim of the container.

4. The lid according to claim 1, wherein the plurality of inverted dimples reverse direction and project upwards beyond the annular top wall to assume a raised position when the lid is firmly seated to the rim of the container.

5. The lid according to claim 1, wherein the annular top wall includes four inverted dimples.

6. The lid according to claim 1, wherein a pressure point is positioned on either side of the dimple.

7. The lid according to claim 4, wherein the raised dimples project beyond the annular top wall.

8. The lid according to claim 6, wherein the pressure point is further defined to include an etching.

9. The lid according to claim 1, wherein the lid is fabricated using a mold configured for female tooling.

10. A lid for sealing a container, the lid comprising:

a closure having a circumferential rim extending about a periphery, wherein the circumferential rim is adapted for mating with a rim of the container;

the circumferential rim further comprising a raised annular inner side wall, a raised annular outer side wall, wherein the outer side wall extends around the inner side wall and is generally parallel to and opposite the inner side wall, the outer side wall and inner side wall being interconnected by an annular top wall, the annular top wall being generally perpendicular to the outer side and inner side walls;

wherein the combination of the raised annular inner side wall, the raised outer side wall and the annular top wall form a channel therebetween;

the annular top wall further including a plurality of inverted dimples individually mounted on a plurality of support bases positioned along a top surface of the annular top wall; and wherein each of the inverted dimples project downward within a cavity of each of the support bases for engaging a container rim when the lid is positioned over the container.

11. The lid according to claim 10, wherein a bottom portion of each of the inverted dimples is for communication with the rim of the container.

12. The lid according to claim 10, wherein at least one of the plurality of inverted dimples reverses direction and projects upwards beyond an apex point of a support base to assume a raised position, pursuant to the application of a downward force to seat the lid to the rim of the container.

13. The lid according to claim 10, wherein the plurality of inverted dimples reverse direction and project upwards beyond the support base to assume a raised position when the lid is firmly seated to the rim of the container.

14. The lid according to claim 10, wherein each support base comprises a plurality of raised panels enclosing a hollow cavity, the panels projecting upwards from the annular top wall and converging together to form a mounting structure for retaining an inverted dimple within the cavity of the support base.

15. The lid according to claim 10, wherein the annular top wall includes four indented dimples individually mounted on four support bases.

16. The lid according to claim 10, wherein the lid is fabricated using a female cavity mold.

17. The lid according to claim 13, wherein the raised dimples project beyond the annular top wall.

18. A lid for sealing a container, the lid comprising:

a closure having a circumferential rim extending about a periphery, wherein the circumferential rim is adapted for mating with a rim of the container;

the circumferential rim further comprising a raised annular inner side wall, a raised annular outer side wall, wherein the outer side wall extends around the inner side wall and is generally parallel to and opposite the inner side wall, the outer side wall and inner side wall being interconnected by an annular top wall, the annular top wall being generally perpendicular to the outer side and inner side walls;

wherein the combination of the raised annular inner side wall, the raised outer side wall and the annular top wall form a channel therebetween;

the annular top wall further including a plurality of support bases positioned along a top surface of the annular top wall, the support bases including dimples individually mounted on each of the plurality of support bases; and wherein each of the dimples occupies a recessed position within a cavity of the support bases.

19. The lid according to claim 18, wherein a bottom portion of the plurality of recessed dimples for communication with the rim of the container.

20. The lid according to claim 18, wherein the plurality of recessed dimples are raised beyond an apex of each of the support bases to assume a raised position when the lid is firmly seated to the rim of the container.

* * * * *